US005722029A

United States Patent [19]

Tomidokoro et al.

[11] Patent Number: 5,722,029

[45] Date of Patent: Feb. 24, 1998

[54] IMAGE FORMING APPARATUS

[75] Inventors: Nobuaki Tomidokoro, Sagamihara; Masami Higuchi, Yokohama; Kunio Hayakawa; Youko Fukui, both of Tokyo; You Masuyama, Kawasaki; Ryoichi Suzuki, Yokohama, all of Japan

[73] Assignee: Ricoh Company, Ltd., Tokyo, Japan

[21] Appl. No.: 731,990

[22] Filed: Oct. 23, 1996

[30] Foreign Application Priority Data

Oct. 24, 1995 [JP] Japan ..... 7-275583

[51] Int. Cl.[6] ..... G03G 15/00

[52] U.S. Cl. ..... 399/389; 271/9.06; 399/45

[58] Field of Search ..... 399/16, 23, 45, 399/81, 381, 389, 391, 382; 271/9.05, 9.06, 9.01, 264, 265.01, 265.02

[56] References Cited

U.S. PATENT DOCUMENTS

| | | | |
|---|---|---|---|
| 4,860,054 | 8/1989 | Higuchi . | |
| 4,933,720 | 6/1990 | Takano et al. | 399/389 |
| 4,975,747 | 12/1990 | Higuchi . | |
| 5,121,169 | 6/1992 | Kawabata | 399/389 |
| 5,130,757 | 7/1992 | Ito | 271/9.06 X |
| 5,131,079 | 7/1992 | Higuchi et al. . | |
| 5,172,178 | 12/1992 | Oushiden et al. | 399/389 X |
| 5,263,698 | 11/1993 | Higuchi et al. . | |
| 5,282,001 | 1/1994 | Watson | 399/389 X |
| 5,452,062 | 9/1995 | Baldwin et al. | 399/382 |
| 5,493,365 | 2/1996 | Matsui et al. . | |
| 5,515,171 | 5/1996 | Nara et al. . | |
| 5,574,551 | 11/1996 | Kazakoff | 399/45 |

*Primary Examiner*—Sandra L. Brase

*Attorney, Agent, or Firm*—Oblon, Spivak, McClelland, Maier & Neustadt, P.C.

[57] ABSTRACT

In an image forming apparatus, the size of sheets (ordinary sheets) set on any tray not set as a tab tray by tab tray setting member is determined by ordinary sheet size sensing member on the basis of the dimension in the sheet feed direction and the dimension in the direction (widthwise) perpendicular to the above direction. On the other hand, the size of sheets (sheets with tabs) set on a tray set as a tab tray is determined by tab sheet size sensing member on the basis only of the dimension in the widthwise direction. If the size of the sheets of the tab tray cannot be determined on the basis only of the above dimension, the size set beforehand is selected. With this configuration, the apparatus is capable of detecting the sizes of various kinds of tab sheets with accuracy.

2 Claims, 21 Drawing Sheets

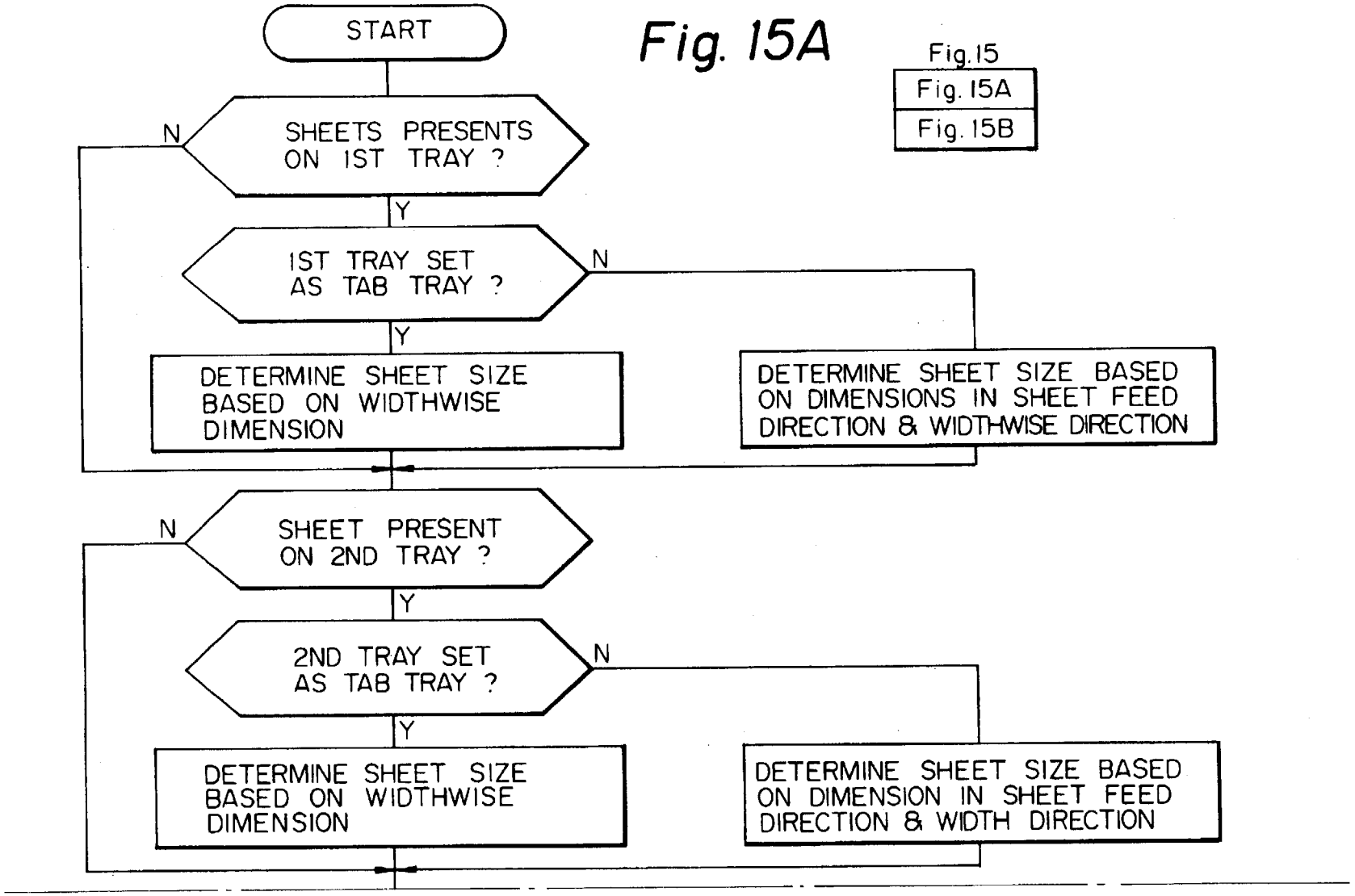
Fig. 15A
Fig. 15
Fig. 15A
Fig. 15B
START
SHEETS PRESENTS ON 1ST TRAY ?
Y
N
1ST TRAY SET AS TAB TRAY ?
Y
N
DETERMINE SHEET SIZE BASED ON WIDTHWISE DIMENSION
DETERMINE SHEET SIZE BASED ON DIMENSIONS IN SHEET FEED DIRECTION & WIDTHWISE DIRECTION
SHEET PRESENT ON 2ND TRAY ?
Y
N
2ND TRAY SET AS TAB TRAY ?
Y
N
DETERMINE SHEET SIZE BASED ON WIDTHWISE DIMENSION
DETERMINE SHEET SIZE BASED ON DIMENSION IN SHEET FEED DIRECTION & WIDTH DIRECTION

IMAGE FORMING APPARATUS

BACKGROUND OF THE INVENTION

The present invention relates to a laser printer, copier, facsimile apparatus or similar image forming apparatus and, more particularly, to an image forming apparatus capable of forming images even on sheets having tabs.

It has been customary with a copier or similar image forming apparatus to use sheets each having a tab. Let this kind of sheets be referred to as tab sheets, as distinguished from ordinary sheets without tabs. The tab sheets are automatically inserted in a set of copies at preselected intervals in order to facilitate the perception of divisions. Image forming apparatuses with this capability are disclosed in, e.g., Japanese Patent Laid-Open Publication Nos. 62-14660 and 3-181955. However, the problem with the prior art apparatuses with the above capability is that because the width of the tabs of tab sheets are fixed, the apparatus cannot accurately determine a tab size when tab sheets with tabs of any different size are loaded on a tray.

SUMMARY OF THE INVENTION

It is therefore an object of the present invention to provide an image forming apparatus capable of determining the sizes of various kinds of tab sheets with accuracy.

An image forming apparatus of the present invention includes a sheet size sensing section for sensing the size of sheets stacked on each of a plurality of trays. A timing control section controls an image forming timing on the basis of the outputs of the sheet size sensing section. A tab tray setting section selectively sets any one of the plurality of trays as a tab tray for stacking sheets each having a tab. The sheet size sensing section is made up of an ordinary sheet size sensing section and a tab sheet size sensing section. The ordinary sheet size sensing section senses the sizes of the sheets stacked on the trays not set as a tab tray by detecting a dimensionin an intended direction of sheet feed and a dimension in a direction perpendicular thereto. The tab sheet size sensing section senses the size of the sheets stacked on the tray set as a tab tray by detecting only a dimension in the direction perpendicular to the intended direction of sheet feed.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
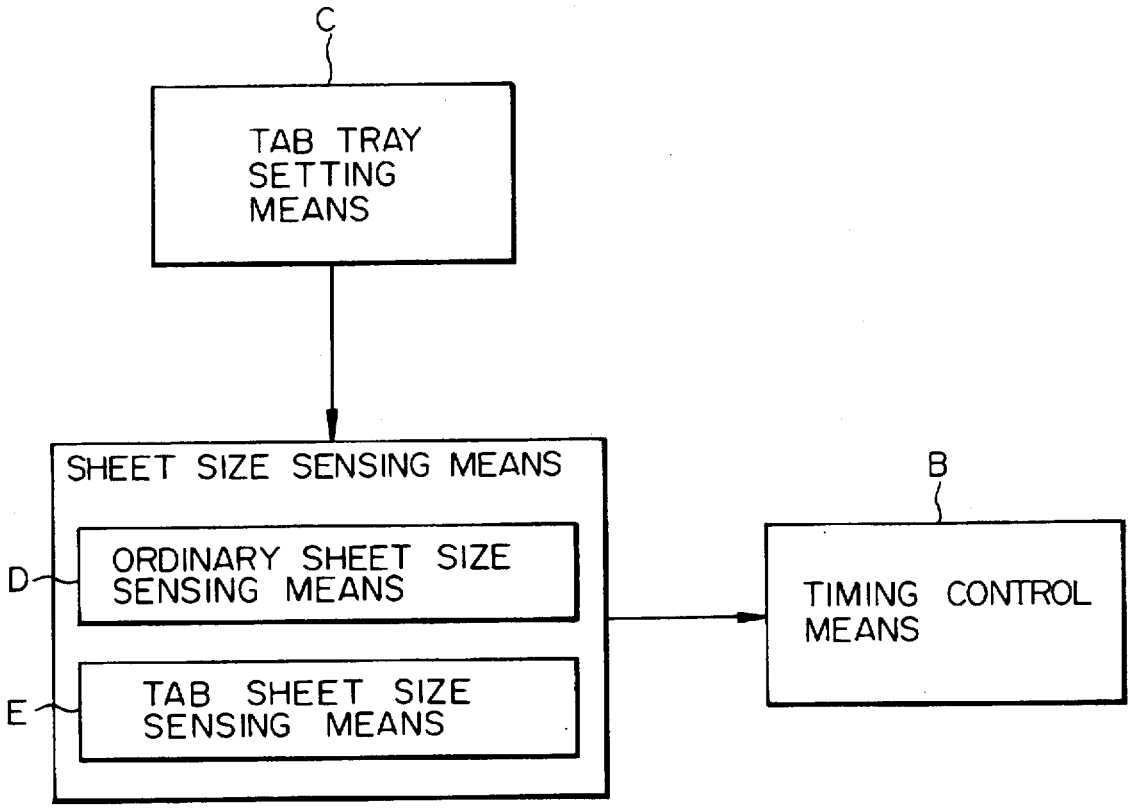
FIG. 1 is a block diagram schematically showing the basic construction of an image forming apparatus in accordance with the present invention.

Referring to FIG. 1 of the drawings, basic functions included in an image forming apparatus in accordance with the present invention are shown. As shown, the apparatus includes sheet size sensing means A for sensing the sizes of sheets loaded on a plurality of trays. Control means B controls the timing of image formation on the basis of the output of the sheet size sensing means A. Tab tray setting means C selectively sets any one of the trays as a tab tray for stacking tab sheets. The size sensing means A is made up of ordinary sheet size sensing means D and tab sheet size sensing means E. The sensing means D determines the sizes of ordinary sheets stacked on the trays which are not set as a tab tray by the setting means C. The sensing means E determines the size of tab sheets stacked on a tray set as a tab tray by the setting means C. For this purpose, the sensing means D senses the dimension of the sheets in an intended direction of sheet feed and the dimension of the same in the direction perpendicular thereto, while the sensing means E senses only the dimension of the sheets in the direction perpendicular to intended direction of sheet feed, as will be described specifically later. When the sensing means E is not capable of determining a sheet size based only on the above dimension, it is preferable to provide means for determining a preselected sheet size to be the sheet size.

Figure 2:
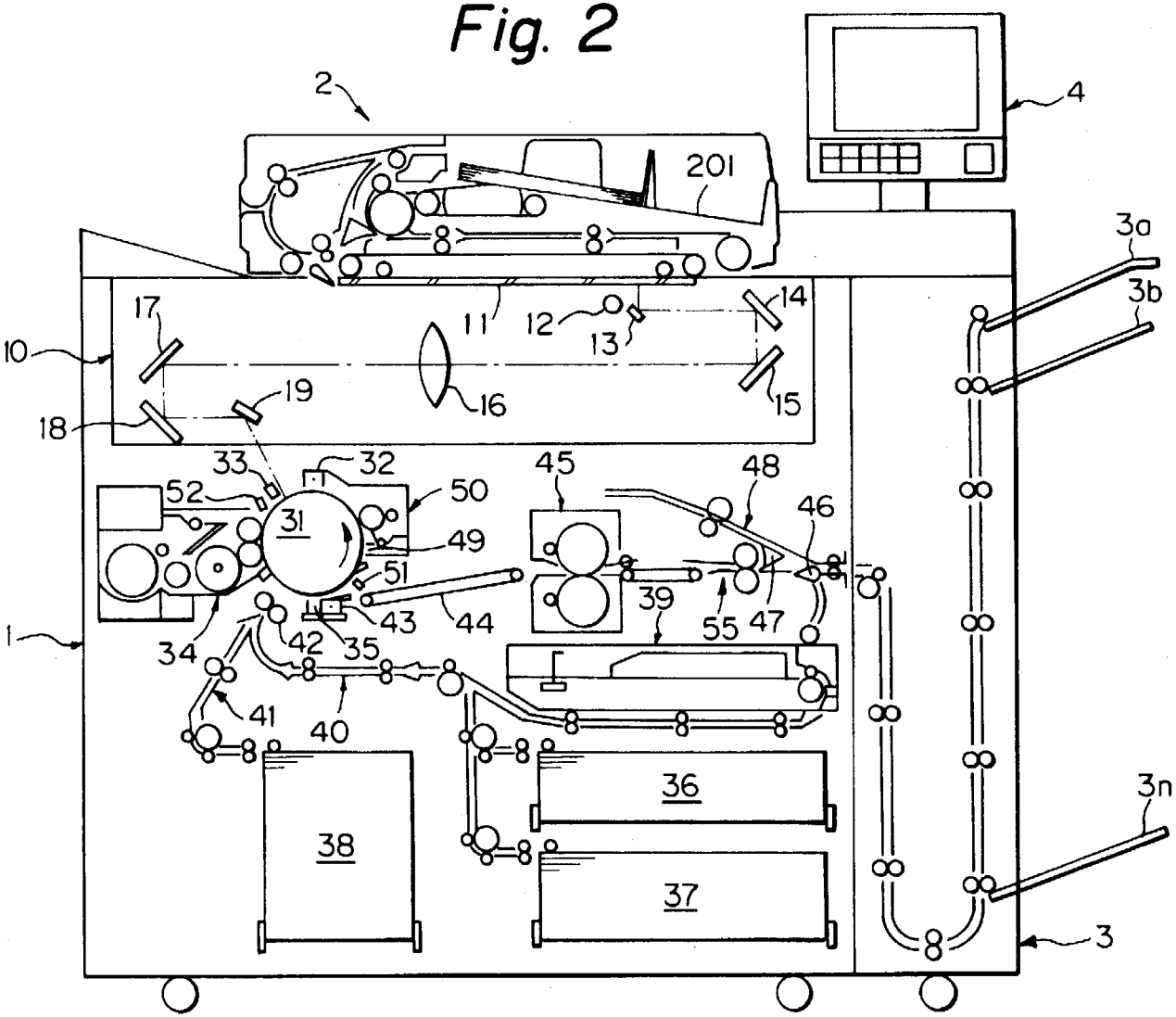
FIG. 2 shows a specific construction of the image forming apparatus in accordance with the present invention and implemented as a copier.

FIG. 2 shows a copier which is a specific form of an image forming apparatus in accordance with the present invention. The copier is an electrophotographic copier (PPC) having a recirculating automatic document feeder (RDF) 2 thereon and a sorter 3 on its copy outlet side.

The RDF 2 includes a document ray 201 to be loaded with a stack of documents. Rollers and a belt, which will be described, cooperate to feed the documents one by one to a glass platen 11 mounted on the top of a scanner 10 included in the copier body 1. A lamp (fluorescent lamp) 12 also included in the scanner 10 illuminates, or scans, the document positioned on the glass platen 11. The resulting reflection from the document is incident to a photoconductive drum 31 via a first mirror 13, a second mirror 14, a third mirror 15, a through lens 16, a fourth mirror 17, a fifth mirror 18, and a sixth mirror 19. The surface of the drum 31 has been uniformly charged by a main charger 32 before the illumination. As a result, a latent image is electrostatically formed on the drum 31. An eraser 33 dissipates the charge from the unnecessary portions of the drum 31. A developing unit 34 develops the latent image with toner so as to produce a corresponding toner image. A transfer charger 35 transfers the toner image from the drum 31 to a sheet.

The sheet is fed from any one of a first to a third tray 36, 37 and 38 and a duplex copy tray 39 along a transport path 40 or 41. A registration roller 42 conveys the sheet to an image transfer station between the drum 31 and the transfer charger 35 such that the leading edge of the sheet meets the leading edge of the toner image. The sheet carrying the toner image thereon is separated from the drum 31 by a separation charger 43 and then conveyed to a fixing unit 45 by a belt 44. The fixing unit 45 fixes the toner image on the sheet with heat.

In a simplex-to-duplex copy mode or a duplex-to-duplex copy mode which will be described, a duplex path selector 46 and a turn path selector 47 are so actuated as to steer the sheet carrying the image on one side thereof, or one-sided sheet, to the duplex copy tray 39. This sheet is again fed to the image transfer station later. In an ordinary simplex copy mode or a duplex-to-simplex copy mode which will be described, the one-sided sheet is fed to a turn-over section 48 with or without the path selector 47 actuated, and then driven into the sorter 3 upside down. Such sheets are selectively distributed to bins 3*a*, 3*b*, . . . , 3*n* included in the sorter 3. Duplex copies each carrying images on both sides thereof are discharged in the same manner as simplex copies produced in the simplex copy mode.

After the separation of the sheet from the drum 31, a charger 49 dissipates the charge remaining on the drum 31, and then a cleaning unit 50 removes the toner also remaining on the drum 31. A toner density sensor 51 senses the toner density (copy density) on the drum 31 while a potential sensor 52 senses the surface potential of the drum 31, as needed.

Figure 3:
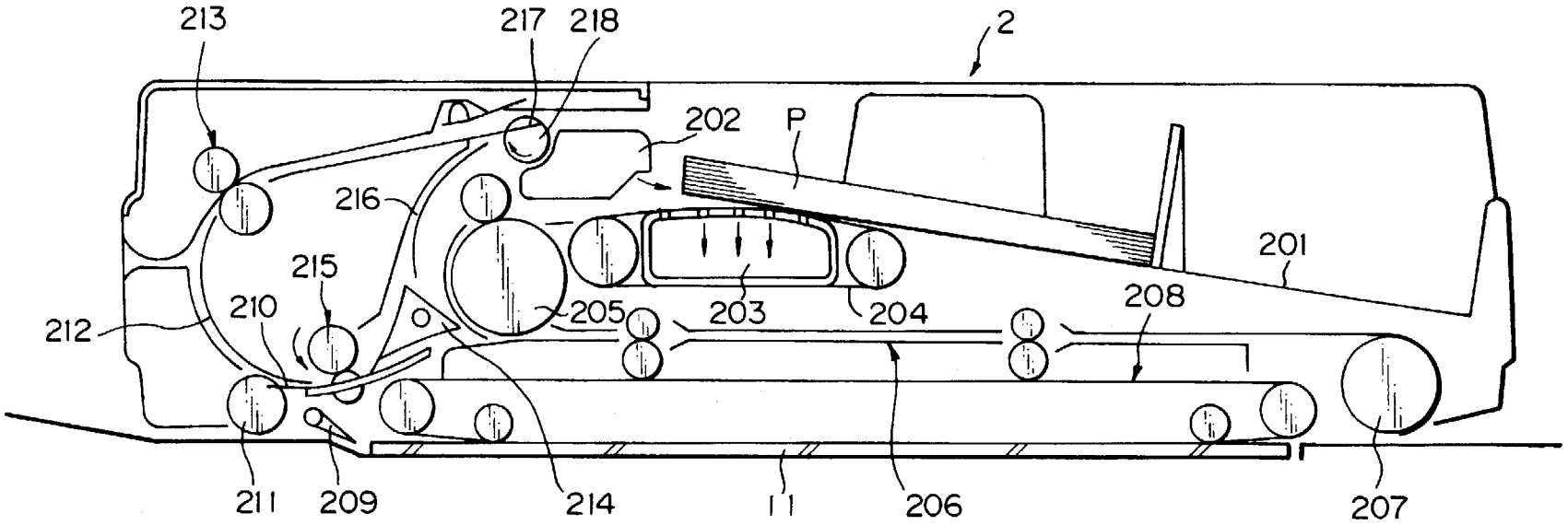
FIG. 3 shows a specific configuration of a recycling document feeder mounted on the copier of FIG. 2.

FIG. 3 shows a specific construction of the RDF 2. As shown, a plurality of documents P are stacked on the document tray 201 face down, i.e., image surfaces facing downward. A mark-off member, not shown, protrudes from a blower tank 202 and has its free end nipped between a vacuum tank 203 and the stack of documents P. When a start key provided on an operation and display panel 4, FIG. 2, is pressed, the mark-off member retracts and again protrudes so as to rest on the top of the document stack P. In this condition, air under pressure is blown out from the flower tank 202 in order to lift the document stack P. The vacuum tank 203 sucks only the bottom document and thereby retains it on a vacuum belt 204. The vacuum belt 204 conveys the document to a document inlet. A feed roller 205 conveys the sheet to an intermediate transport path 206 and stops it there for a moment. Then, a turn roller 207 and a belt 208 convey the sheet to a preselected position on the glass platen 11.

The scanner 10, FIG. 2, scans one surface (front) of the document laid on the glass platen 11 at a preselected timing. Subsequently, the belt 208 conveys the document away from the glass platen 11. A pawl 209 picks up the document, and then a guide 210 drives the document into a turn-over path 212 by pressing it against an inlet roller 211. The document discharging operation to follow depends on the copy mode, as follows.

In the simplex copy mode or the simplex-to-duplex copy mode, after the trailing edge of the document driven into the turn-over path 212 has moved away from the inlet roller 211, a switch-back roller 213 is rotated in the reverse direction. As a result, the document is switched back and guided along the guide 210 and the upper portion of a path selector 214. At the same time, a pull-out roller 215 conveys the document into an outlet path 216. A stationary presser 217 presses the document against an outlet roller 218. Consequently, the document is driven out of the RDF 2 onto the document stack P with the front facing upward. The previously mentioned mark-off member divides the document driven out of the RDF 2 from the documents existing on the tray 201.

In the duplex-to-duplex copy mode or the duplex-to-simplex copy mode, after the trailing edge of the document driven into the turn-over path 212 has moved away from the inlet roller 211, the path selector 214 is so switched as to steer the document into the intermediate path 206 again. The switch-back roller 213 is reversed to switch back the document. The document is again driven into the intermediate path 206 by the pull-out roller 215 and feed roller 205 while being guided by the guide 210 and the lower portion of the path selector 214. After a temporary stop in the path 206, the sheet is again brought to the glass platen 11 by the turn roller 207 and belt 208 with the rear thereof facing downward. After the rear of the document has been scanned by the scanner 10, the document is conveyed away from the glass platen 11 by the belt 208. Then, the document is driven out onto the document stack P existing on the tray 201 in the previously described manner.

Figure 4:
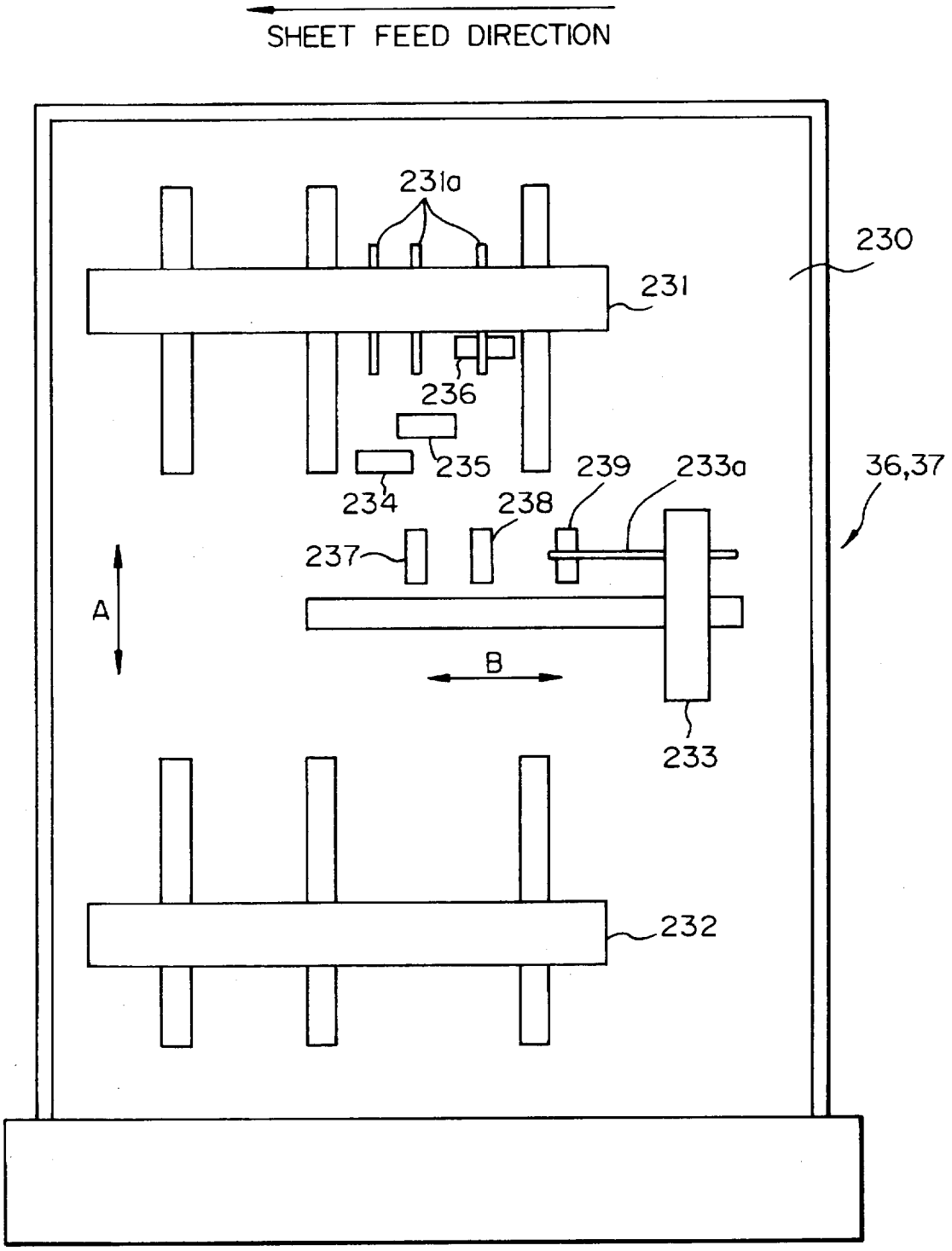
FIG. 4 is a plan view showing a specific configuration of each of a first and a second tray included in the copier of FIG. 2.

FIG. 4 shows a specific configuration of one of the first and second trays 36 and 37. As shown, the tray 36 or 37 includes a bottom plate 230 for supporting a stack of sheets. The bottom plate 230 is movable up and down such that the top sheet is always ready to be paid out by a pick-up roller which will be described. Side guides 2311 and 232 are slidable in a direction (arrow A; widthwise direction) perpendicular to an intended direction of sheet feed (arrow B) in order to position the sheet stack in the direction A. Interrupt pieces 231*a* are affixed to one side guide 231 in order to detect the widthwise dimension of the sheets. When one of the side guides 231 and 232 is moved, the other side guide is moved by the same distance as, but in opposite direction to, the above side guide. A back fence 233 is slidable in the direction B in order to position the sheet stack in the direction B. An interrupt piece 233*a* is affixed to the back fence 233 in order to detect the dimension of the sheets in the direction B.

Size sensors 234–239 are affixed to the bottom plate 230 at positions where they can detect the interrupt pieces 231*a* of the side guide 231 or the interrupt piece 233*a* of the back fence 233. Table 1 shown below lists the outputs of the size sensors 234–239 (size detection Nos. 1–6) determined by the positions of the interrupt pieces 231*a* and 233*a* when the sheet stack are positioned by the side guides 231 and 232 and back fence 233. The size of the sheets stacked on the tray 36 or 37 can be determined on the basis of the combination of the outputs of the size sensors 234–239. This is also true with the third tray 38.

TABLE 1

| SIZE DETECTION NOS. | 1 | 2 | 3 | 4 | 5 | 6 |
|---|---|---|---|---|---|---|
| DLT WIDTH | 0 | 0 | 1 | 0 | 0 | 1 |
| A3 WIDTH | 0 | 0 | 1 | 0 | 0 | 0 |
| B4 WIDTH | 0 | 1 | 1 | 0 | 0 | 1 |
| A4 WIDTH | 1 | 1 | 1 | 0 | 0 | 0 |
| A4 LENGTH | 1 | 0 | 0 | 0 | 0 | 0 |
| B5 WIDTH | 1 | 1 | 0 | 0 | 1 | 0 |
| B5 LENGTH | 0 | 0 | 0 | 0 | 0 | 1 |
| A5 WIDTH | 1 | 0 | 0 | 1 | 0 | 0 |
| LG WIDTH | 0 | 1 | 1 | 0 | 0 | 0 |
| LT WIDTH | 0 | 1 | 0 | 0 | 0 | 0 |
| LT LENGTH | 1 | 0 | 0 | 0 | 0 | 1 |
| 210 × 170 WIDTH | 1 | 0 | 0 | 1 | 1 | 0 |
| 210 × 182 WIDTH | 1 | 0 | 0 | 0 | 1 | 0 |

0: No interrupt

Figure 5:
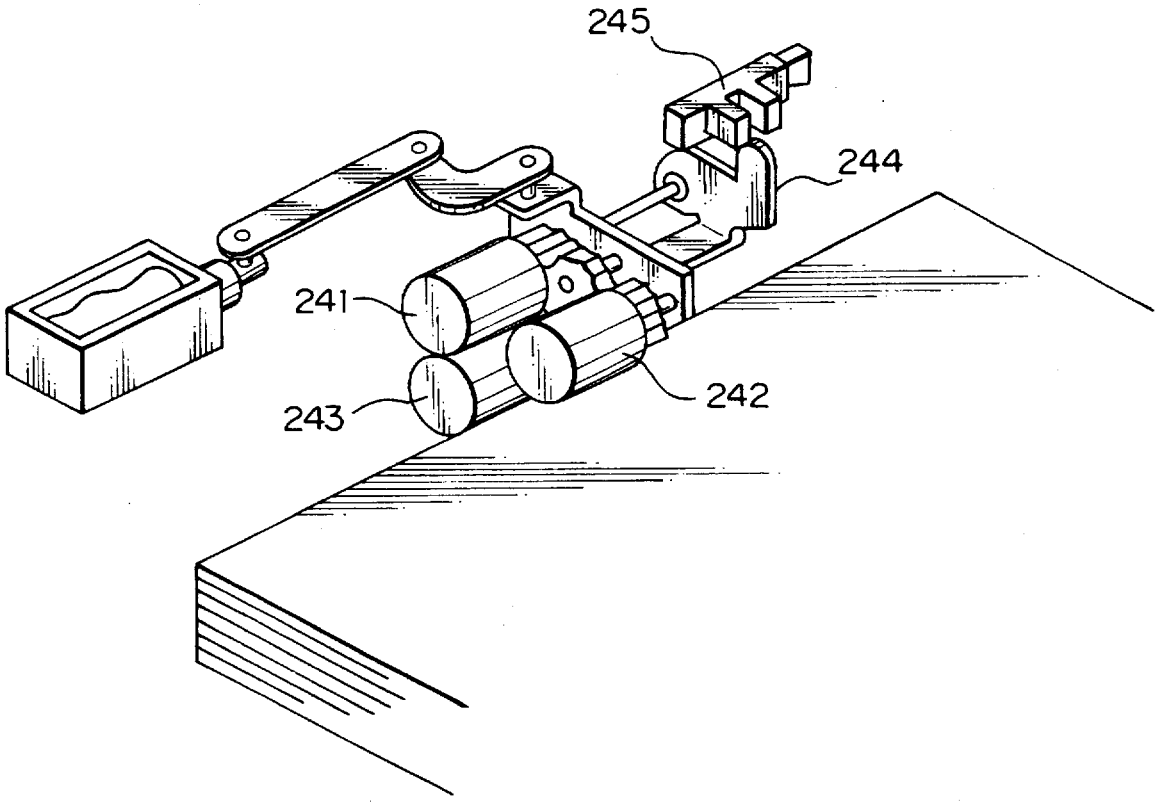
FIG. 5 is a perspective view showing a specific configuration of a sheet feed section included in the copier of FIG. 2.

FIG. 5 shows a specific configuration of a sheet feed section assigned to any one of the first to third trays 36–38. As shown, a pick-up roller 242 cooperates with a feed roller 241 to pay out a sheet to a position where a sheet sensor, not shown, is located. When the sheet sensor senses the leading edge of the sheet, the feed roller 241 stops rotating for a moment in order to regulate the interval between consecutive sheets. On the elapse of a preselected period of time, the feed roller 241 again starts rotating and drives the sheet in cooperation with a grip roller 243. Assume that the pick-up roller 242 resting on the top of the sheet stack is lowered due to the repeated sheet feed. Then, an interrupt plate 244 associated with the pick-up roller 242 is also lowered and brought out of the sensing range of an upper limit sensor 245. Then, a motor, not shown, is driven to raise the bottom plate 230, FIG. 4, until the upper limit sensor 245 again senses the interrupt plate 244.

Figure 6:
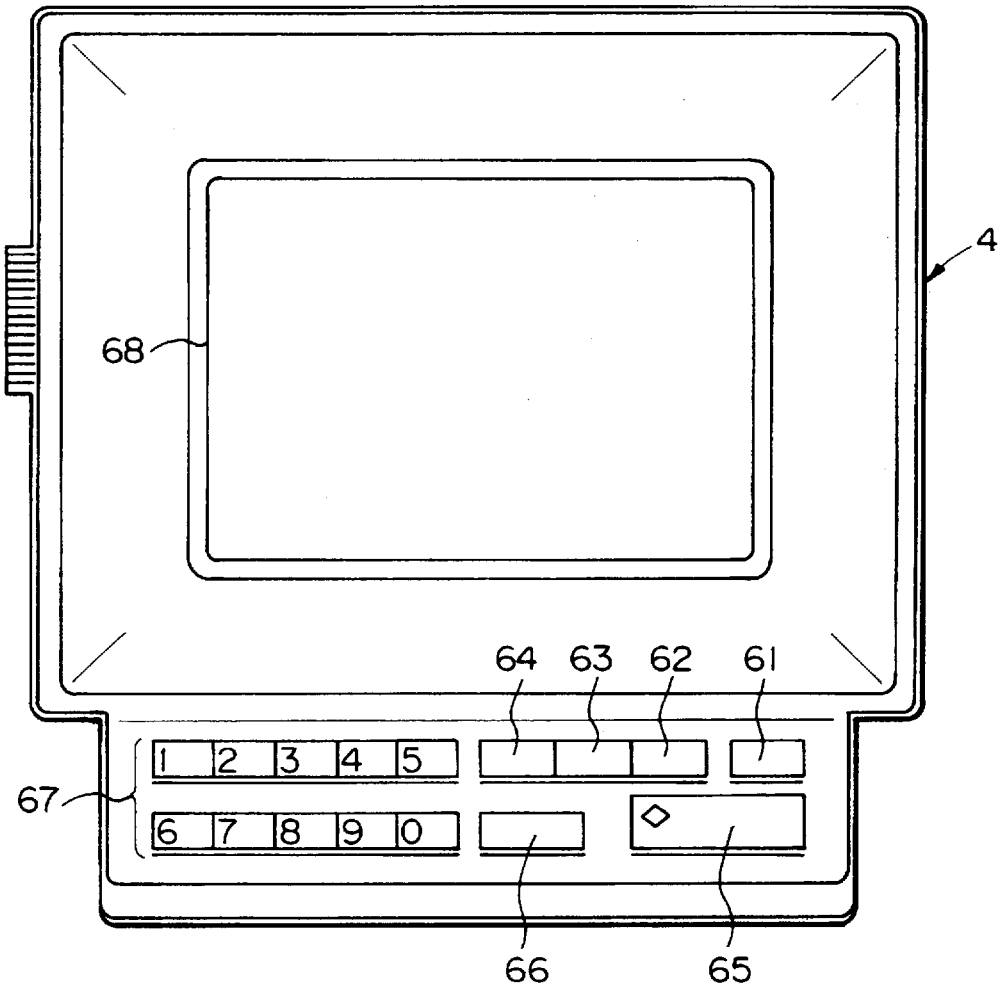
FIG. 6 is an external view showing a specific configuration of an operation and display panel included in the copier of FIG. 2.

A specific configuration of the operation and display panel 4 is shown in FIG. 6. As shown, the panel 4 includes a mode clear key 61, an interrupt key 62, a program key 63, a guidance key 64, a start key 65, a clear/stop key 66, numeral keys 67, and a display 68. When the mode clear key 61 is pressed, various functions (modes) available with the copier are restored to standard functions, i.e., a repeat number (copy number) "1", automatic density (toner density), automatic sheet feed, and ×1 magnification. All the other functions including the duplex copy mode are cancelled. The interrupt key 62 may be operated to copy another document while the copier is in operation. The program key 63 may be operated to register and call copy modes which the user often uses. The guidance key 64 may be operated to see guidance relating to the basic operation and functions on the display 68.

To start a copying operation, the start key 65 is pressed. The start key 65 also plays the role of a read/wait key; a green light emitting diode (LED) and a red LED respectively turn on in a ready state and a wait state. The clear/stop key 66 functions as a clear key in a stand-by state or as a stop key during copying operation. Specifically, when the key 66 is pressed in the stand-by state, the present repeat number is cleared. When the key 66 is pressed during copying operation, the copying operation ends when the current copying cycle ends. The numeral keys 67 are accessible for setting a desired number of copies, zoom magnification, and binding margin.

The display 68 has a CRT (Cathode Ray Tube) or an LCD (Liquid Crystal Display) and a touch panel. The operator may touch keys on the touch panel in order to input various information or to see the operating statuses, messages, etc. It is to be noted that the keys ready to be touched are indicated by black letters on white background and are highlighted when determined to have been touched.

Figure 7:
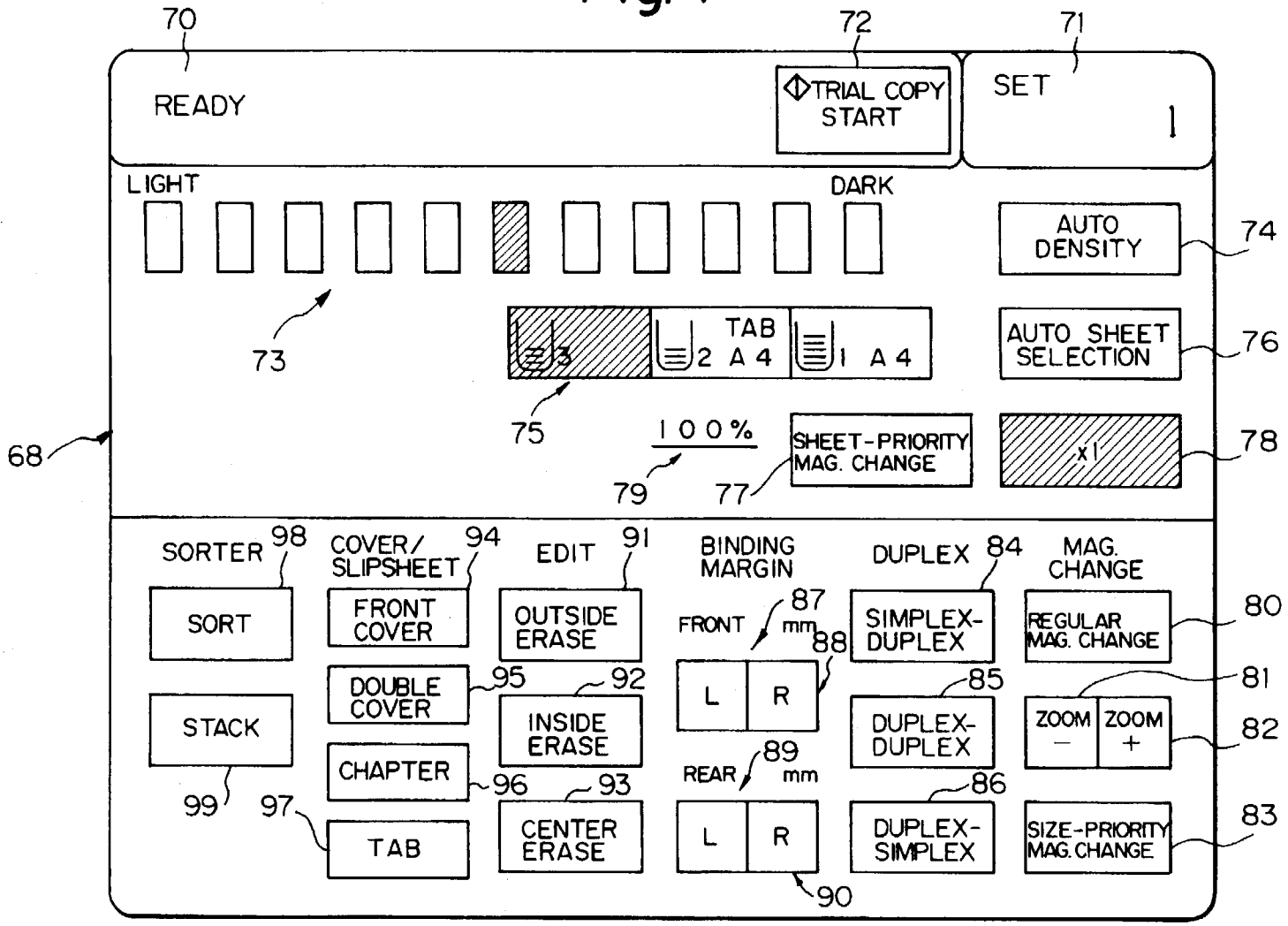
FIG. 7 shows a specific mode setting picture to appear on a display included in the operation and display panel of FIG. 6.

FIG. 7 shows a specific picture appearing on the display 68 and available for setting desired modes. As shown, the picture includes a message area 70 for displaying various kinds of messages including "Ready" and "Status: Copying". A set display area displays the repeat number set by the operator. A trial copy start key 72 is used when the operator desires a trial copy. This key 72 does not appear in the picture or accept an input when a trail copy is inhibited. A density key 73 is used to adjust the copy density manually. An auto density key 74 is used to cause the copy density to be automatically adjusted in matching relation to the background density of a document. A tray select key display area 75 shows the sizes, remaining amounts and kinds of sheets and allows the operator to select a desired tray (size and kind of sheets) manually. When the operator touches any one of the keys in the area 75, there appears the size, remaining amount and kind of sheets existing in the tray designated by the key.

An auto sheet select key 76 is touched when the copier should automatically select sheets of the, same size as documents. A sheet-priority magnification change key 77 is touched to cause the copier to automatically reduce or enlarge the images of documents in accordance with the sheet size selected. A ×1 key 78 is touched to effect ×1 copying. A magnification display area 79 shows a magnification. A regular magnification change key 80 is accessible in order to effect reduction or enlargement of regular size. Zoom keys 81 and 82 are used to select a magnification on a 1% basis. A size-priority key 83 is used to effect reduction or enlargement to a desired size. A simplex-to-duplex key 84 is used to select the simplex-to-duplex copy mode for copying two one-sided or simplex documents on the front and rear of a single sheet.

A duplex-to-duplex key 85 is touched to select the duplex-to-duplex copy mode for copying the images of a single two-sided or duplex document on both sides of a single sheet. A duplex-to-simplex key 86 is used to copy the images of a single duplex document on one side of each of two sheets. A front margin display area 87 shows the dimension of a front binding margin. A front bind key 88 is used when simplex documents or simplex copies need a binding margin. The margin may be set at the right or the left, as desired, so long as it is not greater than 21 mm. A rear margin display area 89 shows the dimension of a rear binding margin. A rear bind key 90 is used when documents or copies carrying images on the rear need a binding margin. This margin may also be set at the right or the left, as desired, so long as it is not greater than 21 mm. An outside erase key 91 is used in an edit mode in order to mark a part of a document and erase the area outside of the marked part on a copy. An inside erase key 92 is used to mark a part of a document and erase the inside of the marked part on a copy A center erase key 93 is used to erase the center of a document on a copy. A front cover key 94 is used to copy the first document or first page on an exclusive cover sheet. A double cover key 95 is used to copy the first and last documents on exclusive cover sheets. A chapter key 96 is used to copy designated documents on exclusive slipsheets. A tab key 97 is used to copy designated portions (pages) of documents on tab sheets. There are also shown in FIG. 7 a sort select key 98 and a stack select key 99.

Figure 8:
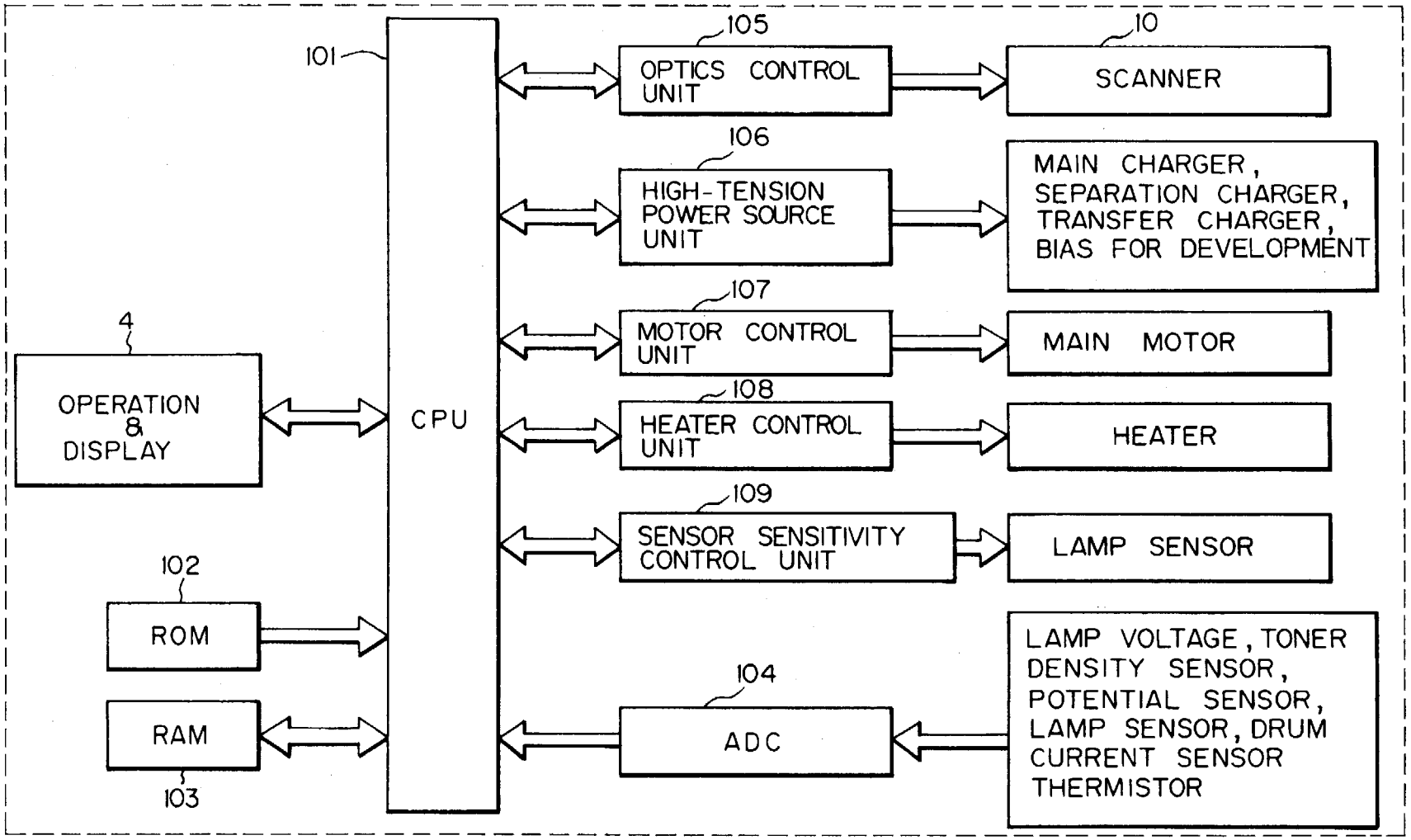
FIG. 8 is a block diagram schematically showing a control system built in the copier of FIG. 2.

FIG. 8 shows a specific control system included in the copier. As shown, a CPU (Central Processing Unit) 101 controls the copier body 1 by using a control program and data stored in a ROM (Read Only Memory) 102. A RAM (Random Access Memory) 103 is used to store the interim results of processing, various set values, and statuses in the copier. An analog-to-digital converter (ADC) 104 digitizes a voltage to be applied to the lamp 12, FIG. 2, the output of the toner density sensor 51, the output of the potential sensor 52, the output of a sensor responsive to the quantity of light issuing from the lamp 12, the output of a sensor responsive to a current flowing through the drum 31, a thermistor voltage in the fixing unit 45, etc. An optics control unit 105 controls the scanner 10.

A high-tension power source unit 106 feeds high voltages to the main charger 32, transfer charger 35, separation charger 43 and charger 49, and feeds a bias voltage for development to a developing roller included in the developing unit 34. A motor control unit 107 controls a main motor for driving the drum 31 and various rollers arranged in the sheet feed section and sheet conveying section. A heater control unit 108 maintains the surface temperature of a heat roller included in the fixing unit 45 in a preselected range. A sensor sensitivity control unit 109 renders, e.g., the gain of the lamp sensor variable.

The control section including the CPU 1, the operation and display panel 4 and the size sensors 234–239 of FIG. 4 constitute the size sensing means A, timing control means B, tab tray setting means C, ordinary size sensing means D, and tab sheet size sensing means E.

Figure 9:
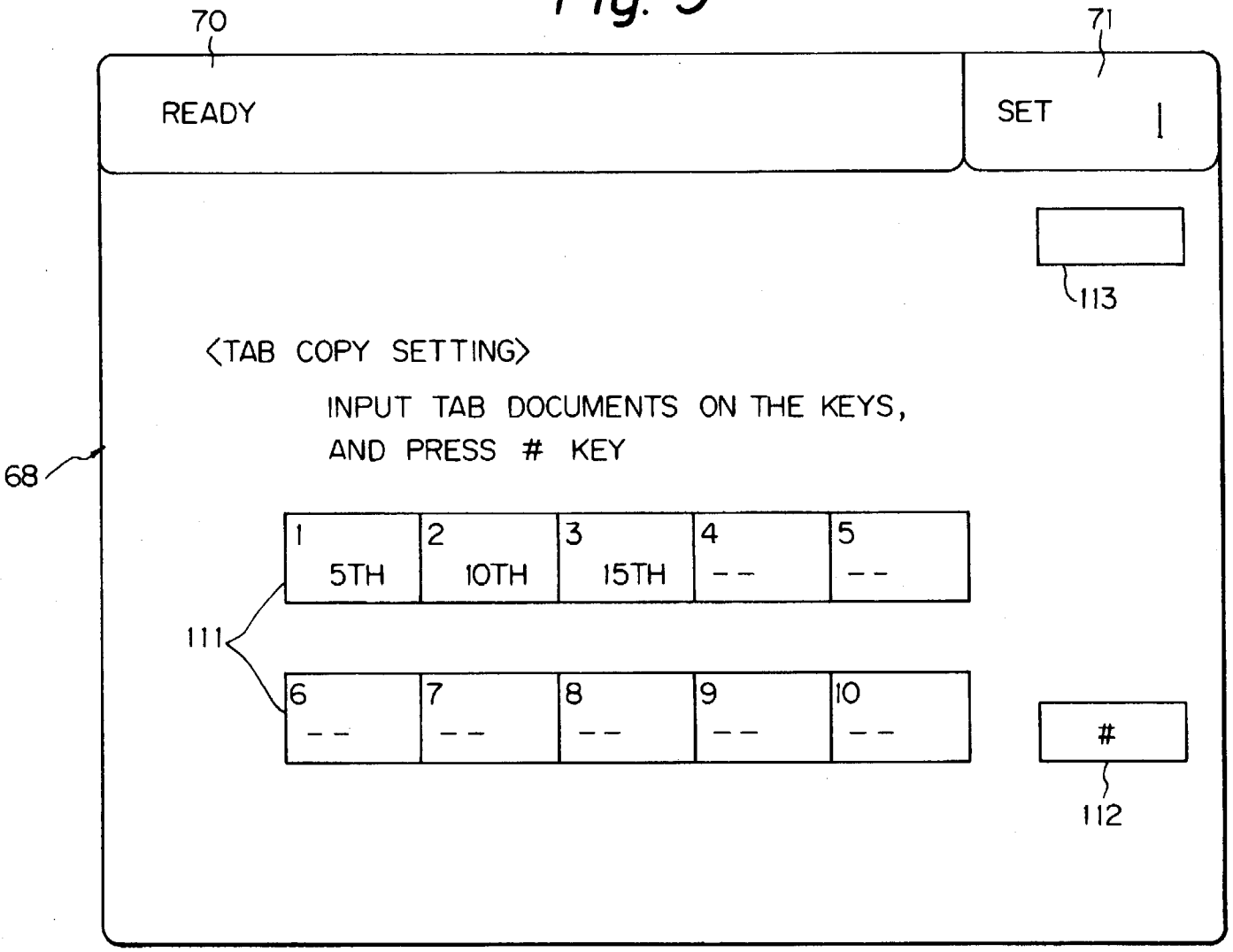
FIG. 9 shows a specific tab copy mode setting picture to appear on the display of FIG. 6.

A reference will be made to FIG. 9 and successive figures for describing various kinds of setting and processing relating to a tab copy mode available with the embodiment. Assume that the operator touches the tab key 97 on the mode setting picture shown in FIG. 7. Then, the mode setting picture is replaced with a tab copy mode setting picture shown in FIG. 9. The words "tab copy mode" refer to a mode for producing the copies of a plurality of documents while replacing a part thereof with tab sheets. The operator operates the numeral keys 67, FIG. 6, to designate a document (tab document) to be copied on a tab sheet. The tab document is displayed on a document display area 111. Then, the operator touches an enter key 112. Subsequently, the operator may designate another tab document on the numeral keys and see it on the display area 111. This can be repeated up to ten tab documents in the illustrative embodiment. When the operator touches an end key 113, the mode setting picture of FIG. 7 again appears on the display 68. If a tab document or tab documents have been entered, the tab copy mode is set up. FIG. 9 shows a specific condition wherein the operator has designated the fifth, tenth and fifteenth documents as tab documents.

Further, a user program (UP) mode is available with the copier. When the user watching the mode setting picture on the display 68 presses the mode clear key 61 and then inputs a code number (e.g. "99911") on the numeral keys 67, a UP mode setting picture shown in FIG. 10 appears on the display 68.

Figure 10:
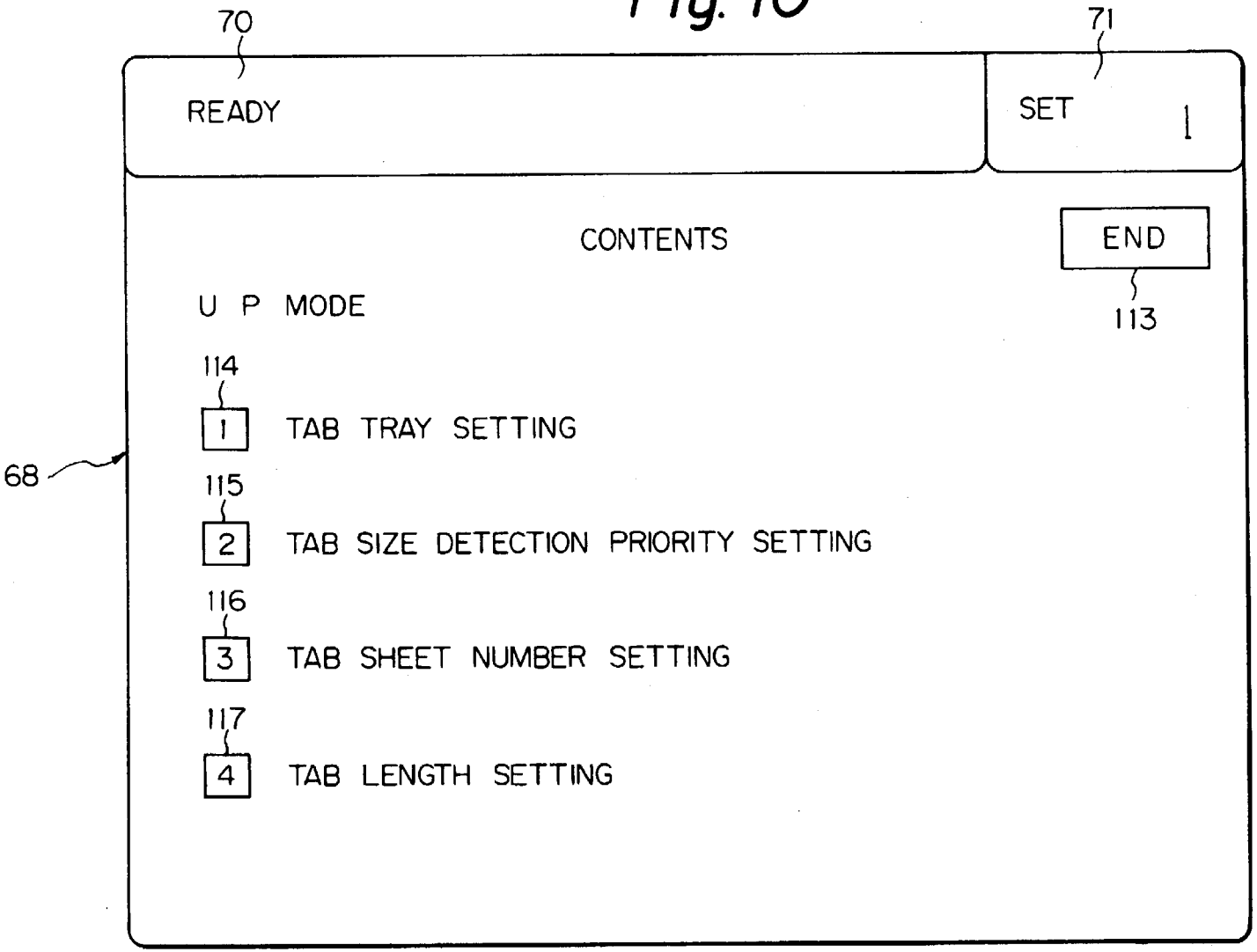
FIG. 10 shows a specific user program mode setting picture to appear on the display of FIG. 6.
Figure 11:
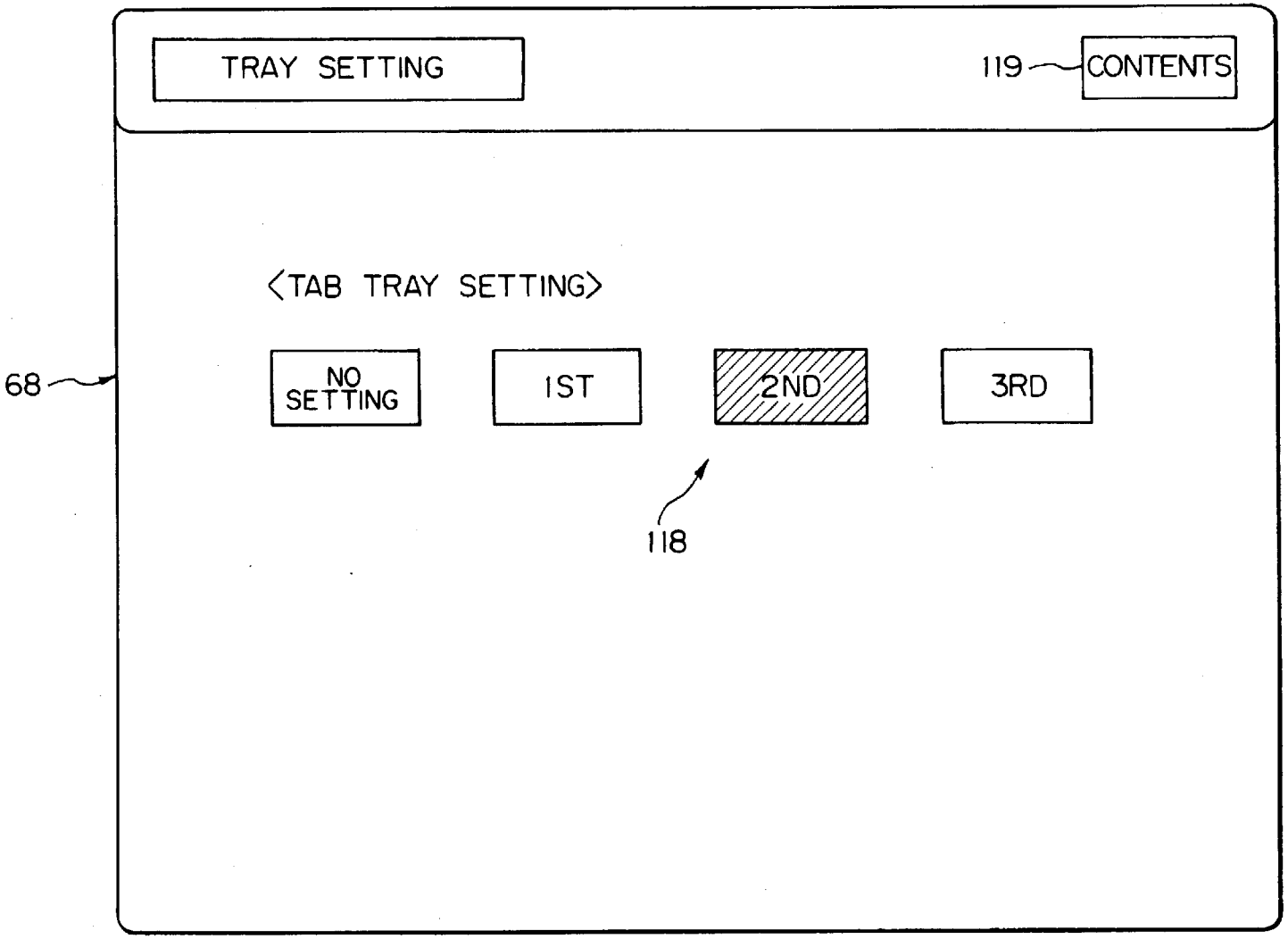
FIG. 11 shows a specific tab tray setting picture to appear on the display of FIG. 6.

When the user touches an end key 113 on the picture of FIG. 10, the mode setting picture again appears on the display 68. On the other hand, when the user touches a "1" key 114, a tab tray setting picture shown in FIG. 11 appears on the display 68. Then, the user presses desired one of tab tray set keys 118 shown in FIG. 11, so that one of the first to third trays 36–38 is set as a tab tray to be loaded with tab sheets. Subsequently, the user touches a content key 119. As a result, the UP mode setting picture shown in FIG. 10 again appears on the display 68.

Figure 12:
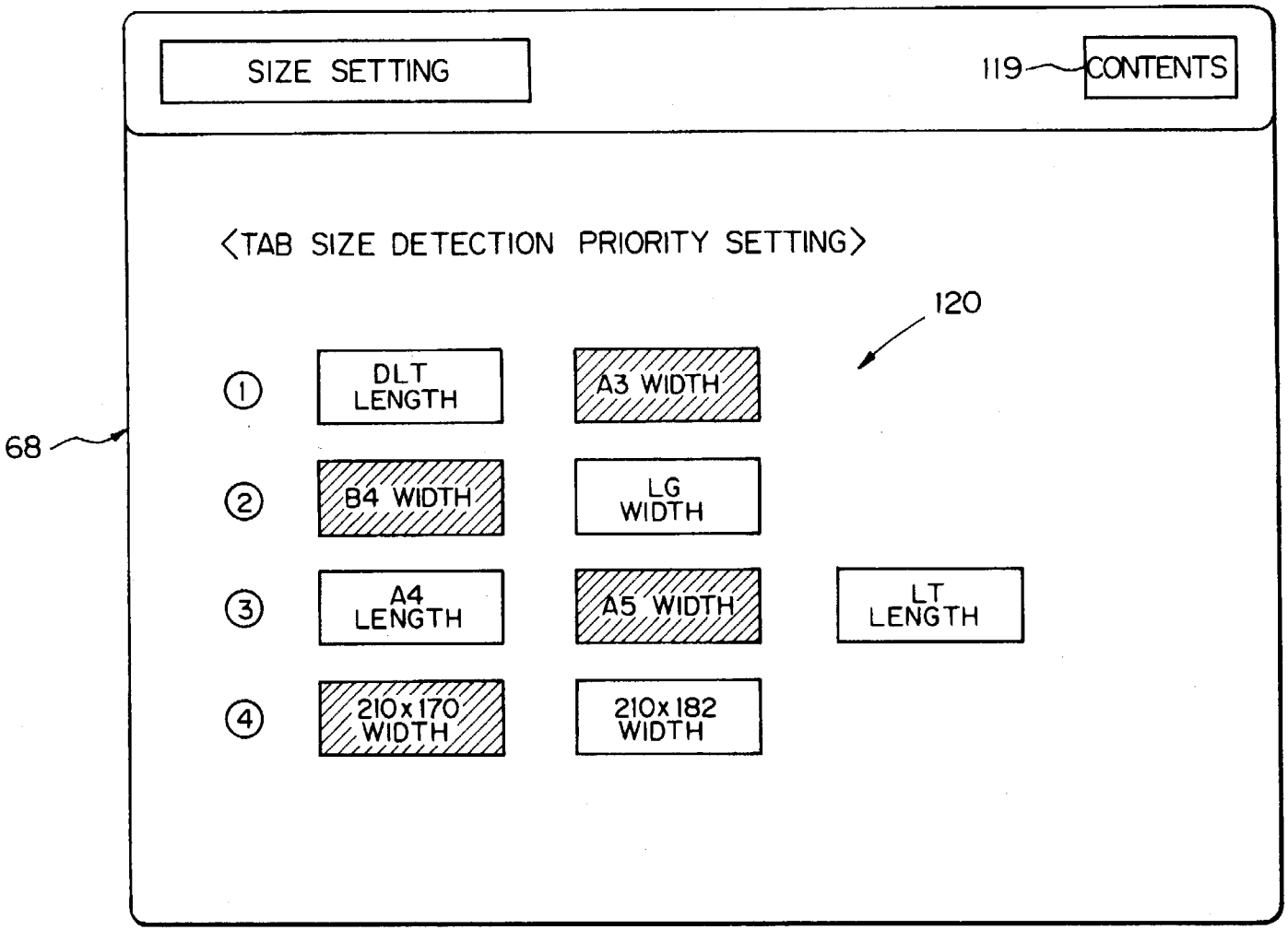
FIG. 12 shows a specific tab size detection priority setting picture to appear on the display of FIG. 6.

When the user touches a "2" key 115 on the picture of FIG. 10, a tab size detection priority setting picture shown in FIG. 12 appears on the display 68. Then, the user may touch any one of priority set keys 120 in order to select a sheet size to be detected with priority. Specifically, the user selects one of a plurality of sizes identical in the dimension in the widthwise direction perpendicular to the feed direction of sheets loaded on the tab tray.

Figure 13:
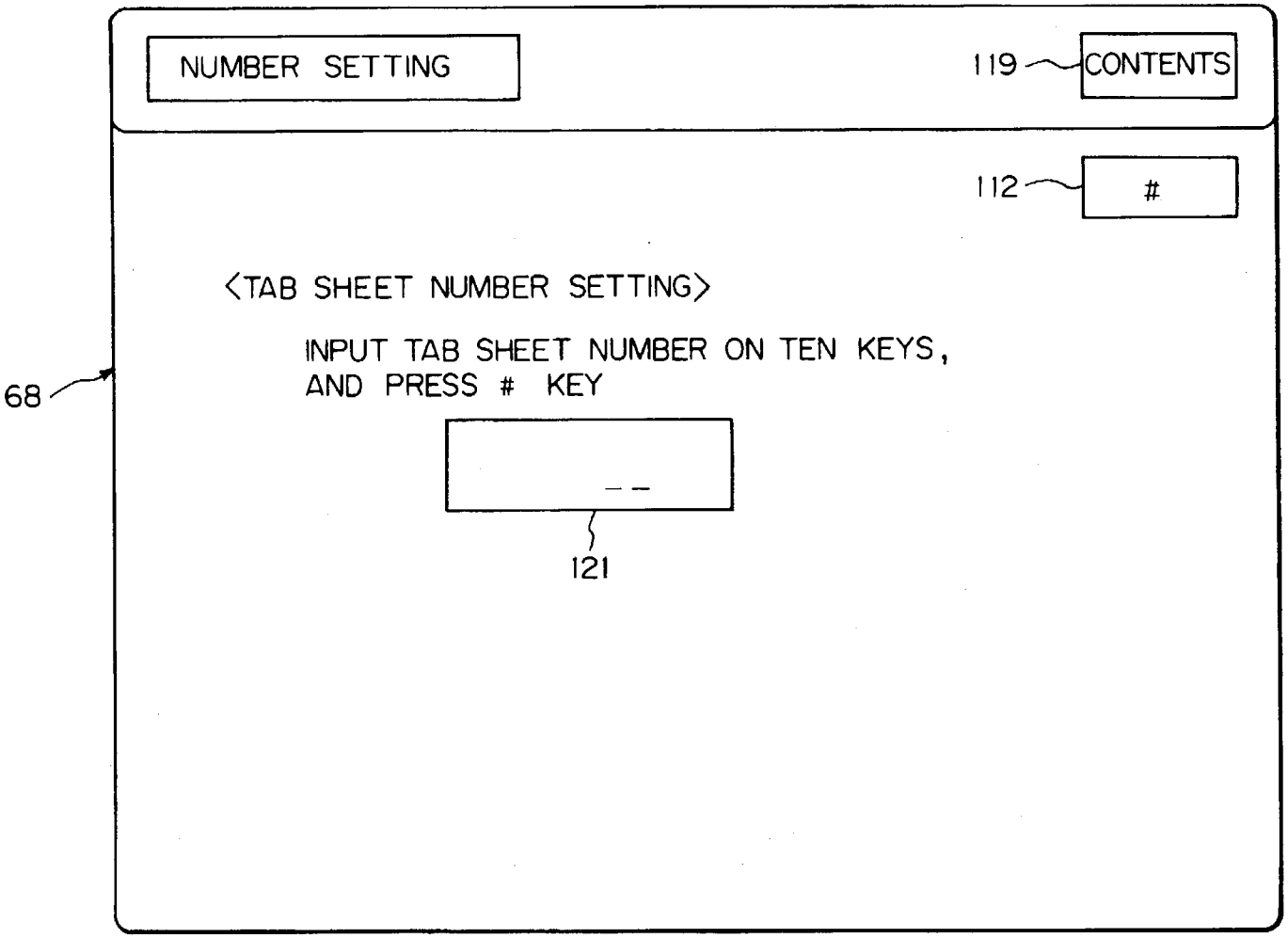
FIG. 13 shows a specific tab sheet number setting picture to appear on the display of FIG. 6.

When the user touches a "3" key 116 on the picture of FIG. 10, a tab sheet number setting picture shown in FIG. 13 appears on the display 68. Watching this picture, the user inputs on the numeral keys 67, FIG. 6, the number of tab sheets (each having a tab at a particular position) to be set on the tab tray for a single set or copy. The number of tab sheets appears on an area 121 shown in FIG. 13. Then, the user touches an enter key 112.

Figure 14:
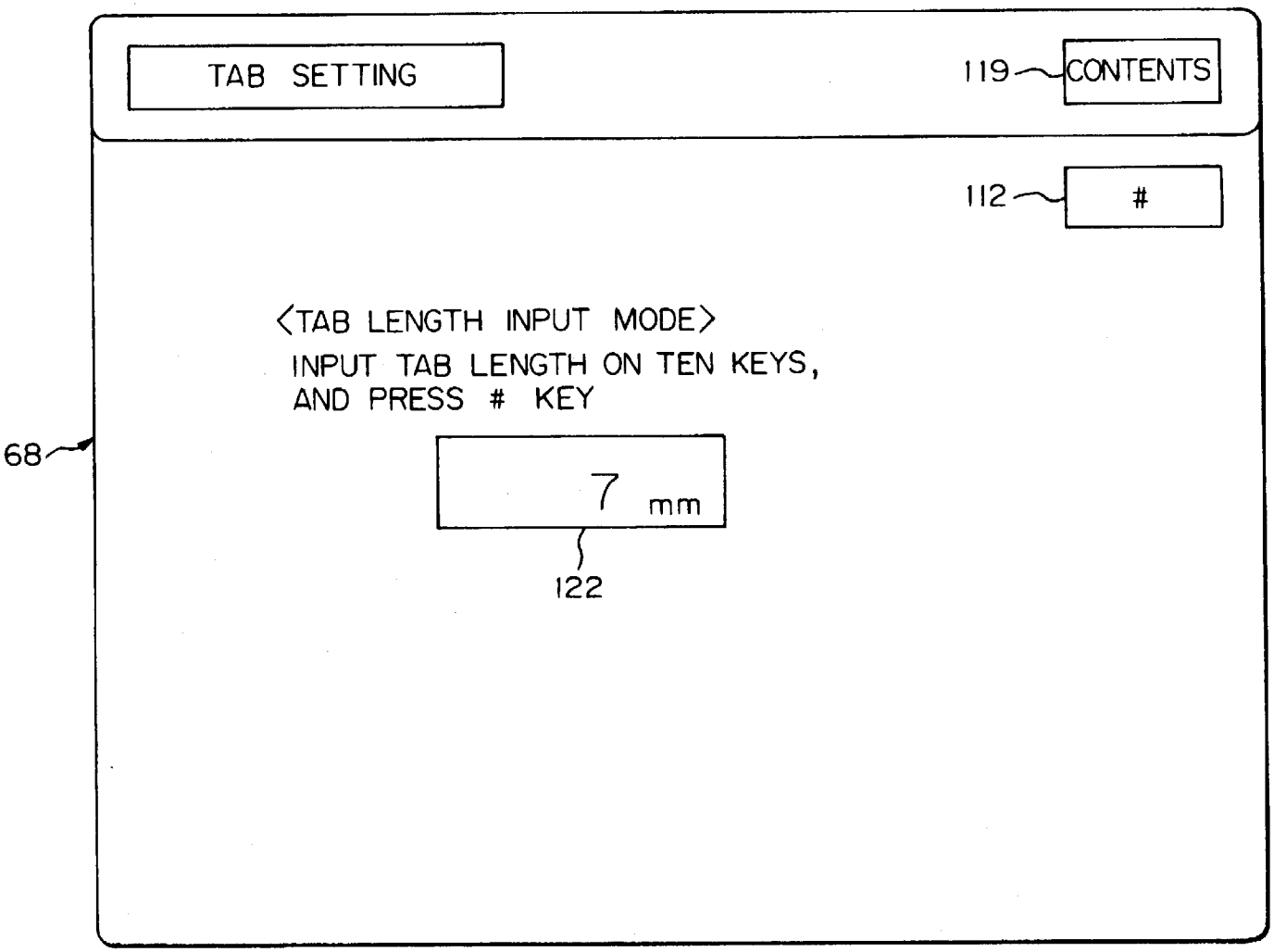
FIG. 14 shows a specific tab length setting picture to appear on the display of FIG. 6.

Further, when the user touches a "4" key 117 on the picture of FIG. 10, a tab length setting picture shown in FIG. 14 appears on the display 68. The user watching this picture inputs the length of a tab on the numeral keys 67, FIG. 6, and sheets it in an area 122. Subsequently, the user touches an enter key 112. FIG. 14 shows a specific tab length of 7 mm input by the user.

Figure 15B:
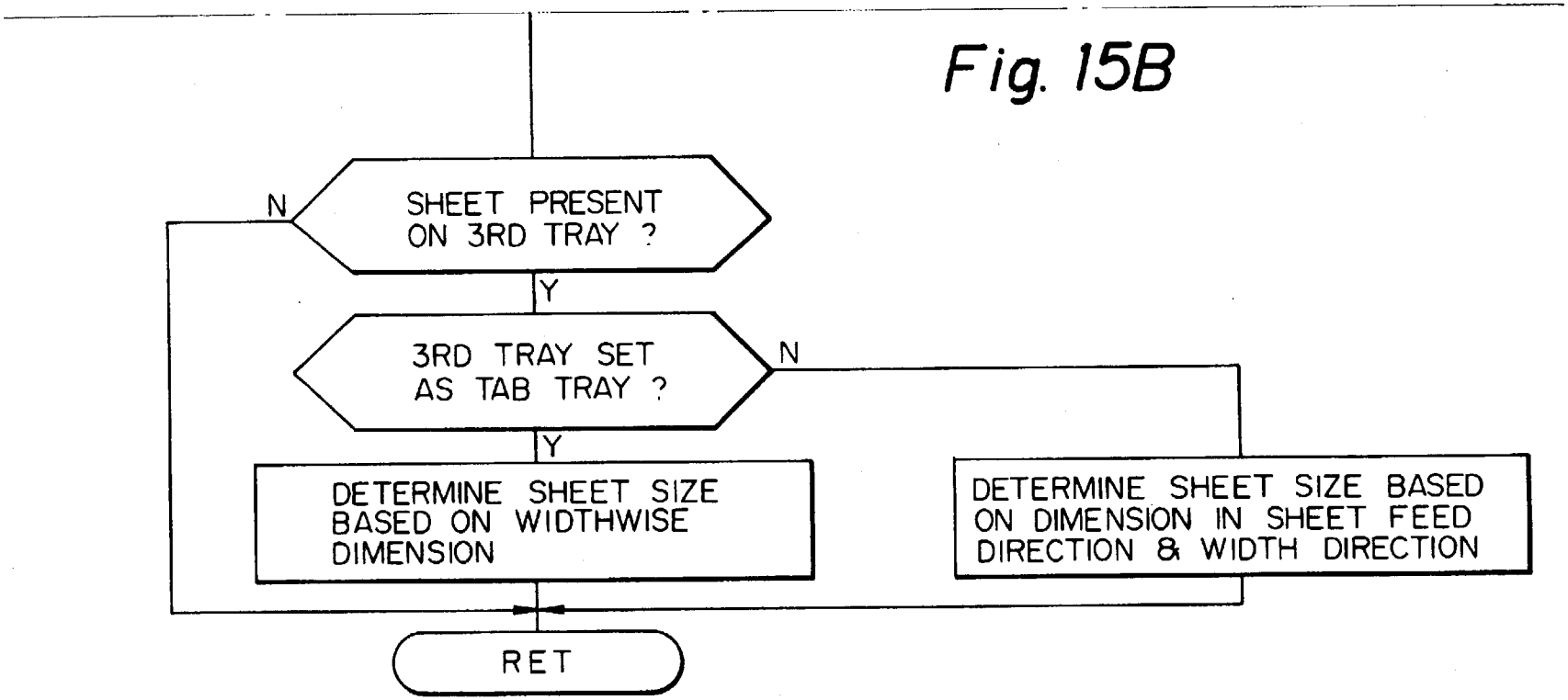
FIG. 15 is a flowchart demonstrating a specific sheet size detection routine to be executed by a CPU (Central Processing Unit) included in the control system of FIG. 8.

Referring to FIG. 15, a specific routine for the CPU 101 to detect sheet sizes will be described. This routine begins when called by a main routine, not shown. First, the CPU 101 determines whether or not sheets exist on the first tray 36. If the answer of this step is positive (Y), the CPU 101 determined whether or not the tray 36 has been set as a tab tray. If the answer of this step is negative (N), i.e., if the tray 36 is loaded with ordinary sheets, the CPU 101 determines the size of the sheets on the basis of the outputs of the size sensors 234–239 (size detection Nos. 1–6 shown in Table 1). If the tray 36 has been set as a tab tray, i.e., if it is loaded with tab sheets (tabs adjoining the back fence 233), the CPU 101 determines the size of the tab sheets on the basis of the outputs of the size sensors 234–236 (size detection Nos. 1–3) (only the dimension in the widthwise direction). As for DTL lengthwise (LENGTH) and A3 widthwise (WIDTH), for example, which are represented by the identical combination of the outputs of the sensors 234–236, the CPU 101 selects the size set on the tab size detection priority setting picture of FIG. 12. Thereafter, the CPU 101 repeats the above sequence of steps with the second and third trays 37 and 38.

Figure 16:
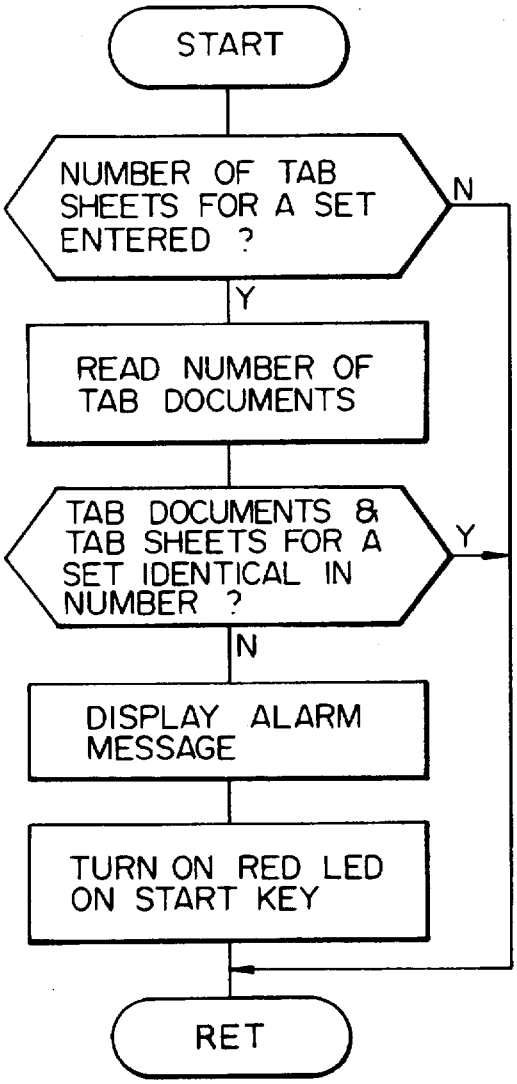
FIG. 16 is a flowchart demonstrating a specific tab copy number checking routine to be also executed by the CPU.

FIG. 16 shows a routine for the CPU 101 to determine the number of tab copies. This routine also begins when called by the main routine. First, the CPU 101 determines whether or not the number of tab sheets for a single set or copy has been set on the picture of FIG. 13. If the answer of this step is positive, the CPU 101 reads out of a memory, not shown, the number of tab documents (to be copied on the tab sheets) set on the picture of FIG. 9. Then, the CPU 101 compares the number of tab documents with the number of tab sheets for a single set. Only if they do not compare equal, the CPU 101 displays an alarm message on the display 68, FIG. 6, and turns on the red LED of the start key 65.

In the illustrative embodiment, up to ten documents can be set as tab documents, as stated earlier. When ten tab documents, for example, are to be reproduced on tab sheets, ten tab sheets must be loaded on the tab tray for a single set or copy; otherwise, when a plurality of sets of tab copies are produced, the tab position will change set by set. Therefore, for accurate tab copying, it is necessary that the number of tab documents set on the picture of FIG. 9 and the number of tab sheets set on the picture of FIG. 13 be identical. This is why the routine shown in FIG. 116 is needed.

Figure 17:
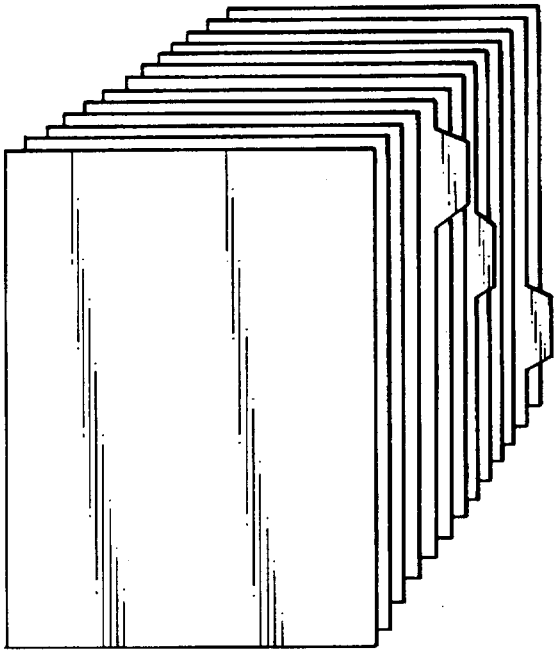
FIG. 17 shows a specific stack of copies including tab sheets and output from the copier of FIG. 2.

Of course, when the number of tab sheets for a single set is greater than the number of tab documents, the excess tab sheets of each set may be removed by hand. However, this will be time- and labor-consuming when the number of tab copies is great. In light of this, tab sheets may be automatically driven out of the copier every time a single set or copy is completed, as follows. Again, the CPU 101 compares the number of tab sheets for a single set and the number of tab documents, and displays the alarm message on the display 68 if they do not compare equal. In this case, however, the CPU 101 does not turn on the red LED of the start key 65, but simply executes tab copying. Assume that all the documents set on the tray 201, FIG. 3, have been driven into and then out of the ADF 2 to produce a set of copies shown in FIG. 17. Then, tab sheets equal in number to the difference between the number of tab sheets for a single set and the number of tab documents are left on the tab tray. The CPU 101 causes the printer to feed and discharge such remaining sheets without forming images thereon.

Figure 18:
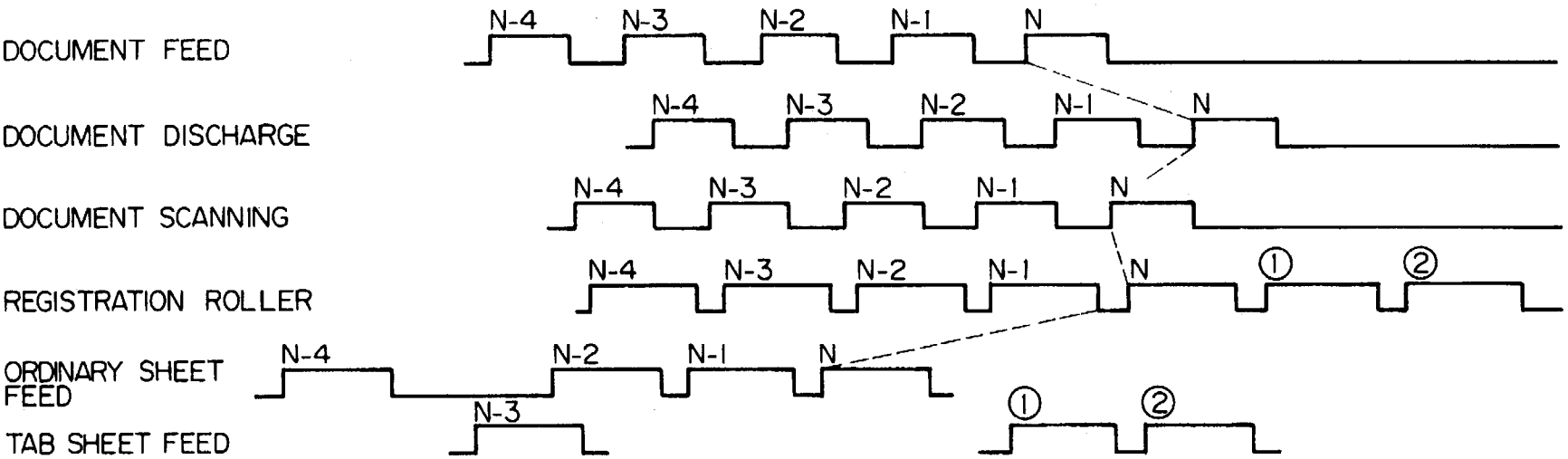
FIG. 18 is a timing chart showing how excess tab sheets are discharged from the copier of FIG. 2 in a tab copy mode.

Specifically, the last five documents of N documents are dealt with, as shown in FIG. 18. Assume that the "N" document is fed from the tray 201 to the glass platen 11, scanned, and then driven out to the tray 201. The "N" document is reproduced on the "N" sheet by being synchronized by the registration roller 42. A tab sheet for the "N-3" document is fed from the tab tray and is the last tab tray for the present set. After the "N" sheet has been fed, tab sheets remaining on the tab tray are sequentially fed and simply driven out. In this case, only the registration roller 42 is selectively turned on and turned off.

Figure 19:
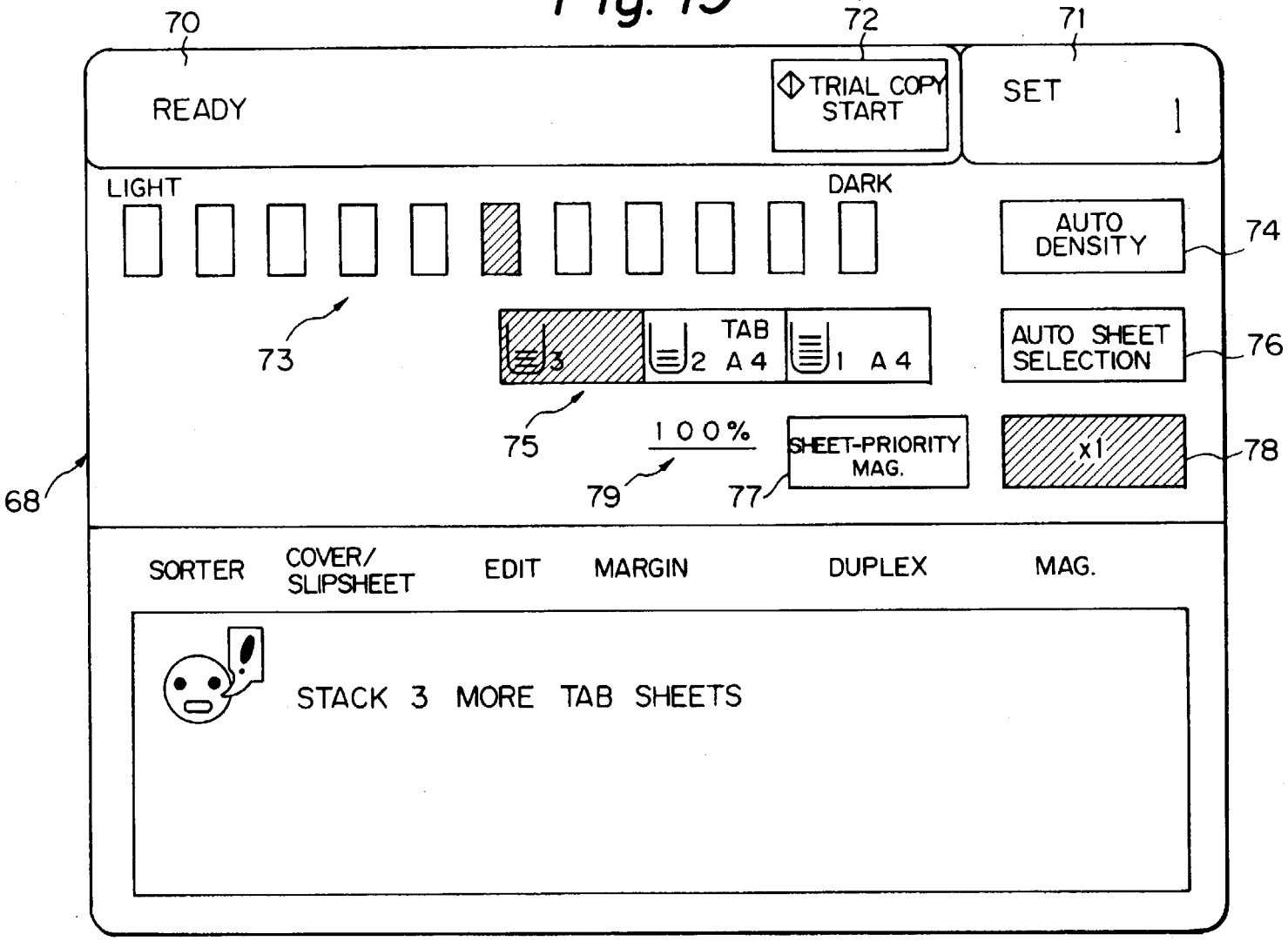
FIG. 19 shows a specific message to appear on the display of FIG. 6 in the event of a jam occurred in the tab copy mode.

Jam recovery in the tab copy mode will be described hereinafter. Assume that a jam occurs in the copier in the tab copy mode, but no tab sheets are left in the copier. Then, it is not necessary to replenish tab sheets to the tab tray. However, when any tab sheet is left in the copier, the number of tab sheets on the tab tray becomes short and must be replenished. For this purpose, every time all the documents have been fed and returned, the CPU 101 counts the number of tab sheets fed and that of tab sheets driven out of the copier. In the event of a jam, the CPU 101 produces a difference between the above two numbers. If the difference is "1" or above, the CPU 101 displays a preselected message on the display 68 to show the operator of the number of tab sheets to be replenished, as shown in FIG. 19 specifically. This procedure enhances the easy operation of the copier.

An alternative jam recovery procedure is as follows. When a tab sheet or sheets are left in the copier in the event of a jam occurred in the tab copy mode, the number of tab sheets remaining in the tab tray becomes short, but the shortage relates only to a single copy; that is, tab sheets for the next set or copy are left in the tab tray. Therefore, before the copying operation is resumed after the jam recovery, the tab sheets may be simply fed and discharged until the next necessary tab sheet appears on the top of the stack so as to be fed immediately. For example, assume that the number of tab documents set on the picture of FIG. 9 is "5", and that after the first and second tab sheets have been fed and driven out as tab copies, a jam occurs when the third and fourth tab sheets are fed. Then, if the first and second tab sheets are again fed and simply driven out after the fifth tab sheet, the third tab sheet can be used. This makes it needless for the operator to replenish tab sheets.

The number of tab sheets to be fed from the tab tray and simply driven out of the copier is produced by:

(number of tab documents)–(number of tab sheets fed–number of tab sheets driven out)

where the number of tab sheets fed refers to the first tab sheet to the last tab sheet for a single set, and the number of tab sheets driven out of the copier.

The copier forms an image on each tab sheet in the tab copy mode, as follows. The operator writes a desired character, mark or the like in the rear portion, in the direction of document feed, of each tab document corresponding to the tabs of the tab sheets. Subsequently, the operator inserts the tab documents into the document stack and then stacks all the documents on the tray 201, FIG. 3. Then, the operator performs various kinds of setting on the operation and display panel 4, and presses the start key 65, as stated earlier. Assume that tab copying is effected in the simplex copy mode by way of example. In response, the RDF 2 sequentially feeds the documents from the tray 201 to the glass platen 11 while the copier sequentially feeds sheets from the tray not set or set as a tab tray. The images of the documents are sequentially reproduced on the sheets by the previously stated manner. At this instant, the timing for copying each tab document on a tab sheet is delayed in matching relation to the length of the tab of the tab sheet, so that the tab coincides with the image existing in the trailing edge portion of the document. This will be described with reference to FIG. 20.

Figure 20:
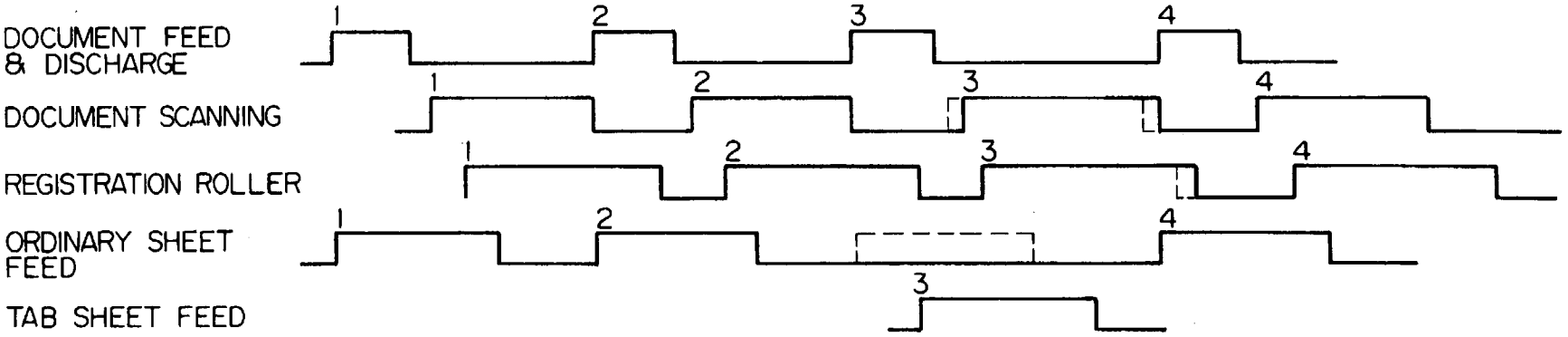
FIG. 20 is a timing chart representative of various operations to occur in the tab copy mode.

In FIG. 20, numerals "1", "2" and "4" indicate the timing for feeding ordinary sheets while the numeral "3" indicates the timing for feeding tab sheets. As shown, to copy a tab document on a tab sheet, the scanner 10 scans the document with a delay corresponding to the shift of the image, so that the image of the trailing edge of the document is reproduced on the tab. In FIG. 20, the difference in timing between the feed of an ordinary sheet and that of a tab sheet is derived from a difference in position between the trays. Dashed lines in FIG. 20 are representative of the ordinary copy timing.

The above delay of the timing for scanning a tab document is necessary for the toner image formed on the drum 31 to be transferred to the tab of the tab sheet. Such a delay requires the registration roller to run (ON) for a longer period of time based on the length of the tab. Therefore, once a tab sheet is fed, the following timing is deviated by a period of time corresponding to the length of the tab.

Further, because the length of the tab of a tab sheet depends on the kind of the sheet, it is necessary for the length of the tab to be freely set by the operator. This is why the tab length setting picture of FIG. 14 appears on the display 68. The above deviation of timing is determined on the basis of the length input on the tab length setting picture.

The amount of shift of the image associated with the length of the tab and that of the image associated with a binding margin must be determined independently of each other; otherwise, the image of a tab document corresponding to the tab of a tab sheet would not be formed. To form such an image accurately, there must be prepared a tab document including the margin by extra work. The illustrative embodiment solves this problem with processing to be described with reference to FIG. 21.

Figure 21:
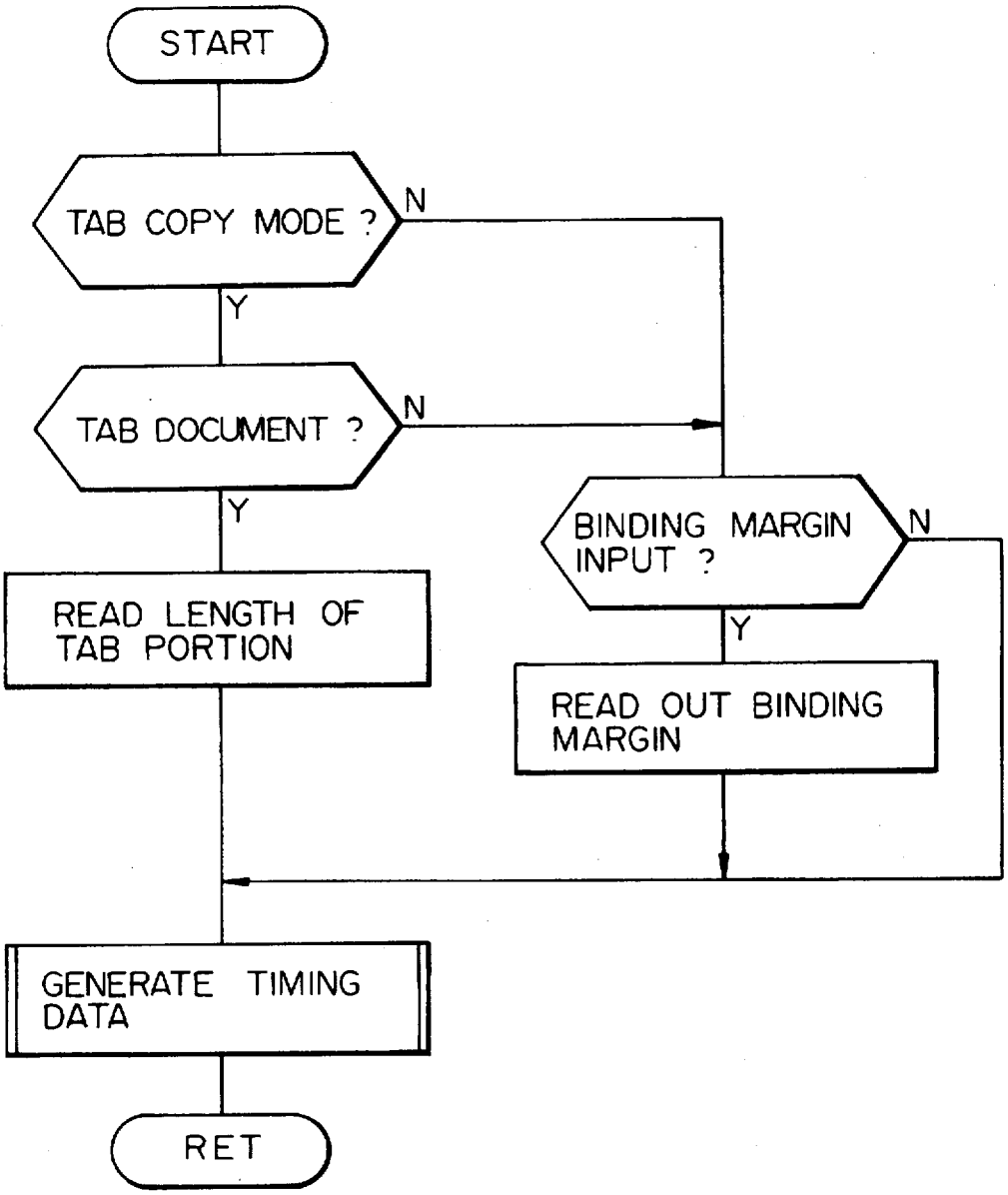
FIG. 21 is a flowchart demonstrating a specific timing determination routine to be executed by the CPU.

FIG. 21 is a flowchart demonstrating a specific procedure for the CPU 101 to determine a timing. This routine also begins when called by the main routine. First, the CPU 101 determines whether or not the tab copy mode has been set up. If the answer of this step is positive, the CPU 101 determines whether or not the document to be fed from the tray 201 next is a tab document to be copied on a tab sheet. If the document is a tab document, the CPU 101 reads out of the memory, not shown, a tab length set on the picture of FIG. 14 and then generates timing data (ordinary timing plus image shift corresponding to the tab). When the tab copy mode is not set up or when the document to be fed next is not a tab document, the CPU 101 determines whether or not a margin has been input. If a margin has been input, the CPU 101 reads a margin value out of the memory and then generates timing data (ordinary timing plus image shift corresponding to the margin). If no margins have been input, the CPU 101 generates ordinary timing data.

Control over turn-over in the tab copy mode is as follows. To turn over an ordinary sheet coming out of the fixing unit 45, the path selector 47 is so positioned as to steer the sheet to the turn-over section 48. After the turn-over sensor 55 has sensed the trailing edge of the sheet entered the turn-over section 48, the path selector 47 is switched to the outlet side in a preselected period of time. As a result, the direction of transport of the sheet is reversed.

On the other hand, when a tab sheet coming out of the fixing unit 45 should be turned, the time when the sensor 55 senses the trailing edge of the sheet depends on the position of the tab, obstructing accurate turning. To solve this problem, when the sensor 55 senses the leading edge of the tab sheet, a timer is started in order to count the period of time in which the sensor 55 senses the trailing edge of the sheet. If the above period of time is identical with a preselected period of time corresponding to an ordinary sheet size, as measured in the sheet feed direction, the CPU 101 determines that the trailing edge of the tab sheet is not a tab. In this case, the CPU 101 causes the turning operation to be effected on the elapse of the above period of time plus a period of time corresponding to the length of the tab. On the other hand, if the period of time counted by the timer corresponds to the ordinary sheet size plus the length of a tab, the CPU 101 causes the turning operation to be effected on the elapse of the above preselected period of time.

In the illustrative embodiment, the size of sheets set on any tray not set as a tab tray is determined on the basis of the dimension in the sheet feed direction and the dimension in the direction (widthwise) perpendicular to the above direction. On the other hand, the size of tab sheets set on a tray set as a tab tray is determined on the basis only of the dimension in the widthwise direction. If the size of the sheets of the tab tray cannot be determined on the basis only of the above dimension, the size set on the picture of FIG. 12 is selected. It is therefore possible to detect the sizes of various kinds of tab sheets surely and accurately, so that image formation can be effected at the optimal timing.

While the embodiment has been shown and described in relation to a copier, the present invention is, of course, applicable to other various kinds of image forming apparatuses including laser printers and facsimile apparatuses.

In summary, it will be seen that the present invention provides an image forming apparatus capable of detecting the sizes of various kinds of tab sheets with accuracy.

Various modifications will become possible for those skilled in the art after receiving the teachings of the present disclosure without departing from the scope thereof.

What is claimed is:

1. An image forming apparatus comprising:

sheet size sensing means for sensing a size of sheets stacked on each of a plurality of trays;

timing control means for controlling an image forming timing on the basis of outputs of said sheet size sensing means; and tab tray setting means for selectively setting any one of said plurality of trays as a tab tray for stacking sheets each having a tab;

said sheet size sensing means comprising:

ordinary sheet size sensing means for sensing a size of the sheets stacked on the trays not set as a tab tray by detecting a dimension of said sheets in an intended direction of sheet feed and a dimension in a direction perpendicular to the intended direction of sheet feed; and tab sheet size sensing means for sensing a size of the sheets stacked on the tray set as a tab tray by detecting only a dimension of said sheets in the direction perpendicular to the intended direction of sheet feed.

2. An apparatus as claimed in claim 1, wherein said tab sheet size sensing means comprises selecting means for selecting, if the size of the sheets set on the tray set as a tab tray cannot be determined on the basis only of the dimension perpendicular to the intended direction of sheet feed, a size set beforehand.

* * * * *